US006109155A

United States Patent [19]

Huang

[11] Patent Number: 6,109,155

[45] Date of Patent: Aug. 29, 2000

[54] PUNCH

[76] Inventor: Bao-Ruh Huang, No. 136, Tsu Chiang Road, Chang Hua, Taiwan

[21] Appl. No.: 09/307,555

[22] Filed: May 10, 1999

[51] Int. Cl.[7] ..... B26F 1/02; B26D 5/16

[52] U.S. Cl. ..... 83/628; 83/620; 83/633; 83/687; 83/698.91; 83/588; 83/167

[58] Field of Search ..... 83/634, 633, 588, 83/618, 620, 167, 687, 691, 697, 694, 698.11, 628, 698.71, 626, 597, 698.91

[56] References Cited

U.S. PATENT DOCUMENTS

| | | | |
|---|---|---|---|
| 332,666 | 12/1885 | Laney | 83/620 X |
| 3,073,199 | 1/1963 | Yerkes | 83/633 X |
| 4,166,404 | 9/1979 | Almog | 83/633 X |
| 4,499,805 | 2/1985 | Mori | 83/588 X |
| 4,713,995 | 12/1987 | Davi | 83/633 X |
| 5,163,350 | 11/1992 | Groswith, III et al. | 83/620 X |
| 5,361,664 | 11/1994 | Desmarais | 83/633 X |
| 5,778,750 | 7/1998 | Drzewiecki et al. | 83/633 X |
| 5,787,783 | 8/1998 | Evans et al. | 83/618 |

*Primary Examiner*—M. Rachuba
*Assistant Examiner*—Boyer Ashley
*Attorney, Agent, or Firm*—Bacon & Thomas, PLLC

[57] ABSTRACT

A punch includes a first member and a second member which has two lugs extending therefrom which are pivotally connected to the first member. Two apertures are defined through the second member. A transverse frame is connected between the two lugs and two punching tools movably extend through the transverse frame. Each punching tool has the first end thereof contacting the underside of the first member and the second end of each punching tool extends through the transverse frame and is located in alignment with the aperture corresponding thereto. A first end of a rod rotatably extends through the second member and the first member, wherein a second end of the rod movably extends through the second member. A handle is pivotally connected to the first end of the rod so that the handle is pivoted relative to the first member to extend the distance between the punching tools and the handle.

5 Claims, 7 Drawing Sheets

PUNCH

FIELD OF THE INVENTION

The present invention relates to a punch, and more particularly, to an improved punch having a pivotal handle which is pivotally connected to the upper member of the punch so that the handle may extend from the upper member to save effort when punching a pile of papers.

BACKGROUND OF THE INVENTION

A cross sectional view of a conventional punch is shown in FIG. 7 and the conventional punch includes an upper member 41, a lower member 42, a collector 420 connected to the underside of the lower member 42, two connection frames 46 (only one is shown) connected between the upper member 41 and the lower member 42, and a transverse frame 43 connected between the two connection frame 46. Two punching tools 44 (only one is shown) each have a spring 440 mounted thereto and the two punching tools 44 extend through the transverse frame 43. The top end of each punching tool 44 contacts the underside of the upper member 41 and the lower end of each punching tool 44 is located in alignment with one of two apertures 421 defined through the lower member 42. Papers (not shown) is inserted between the transverse frame 43 and the lower member 42, when pushing the upper member (41), the lower end of each punching tool 44 penetrates the papers and extends into the aperture 421 so that the papers each have two holes. Nevertheless, because the distance between the punching tools 44 and the distal end of the upper member 41 is limited, so that the user has to use a large force to force the punching tools 44 through the papers. This is one of the reasons that the thickness of the papers to be punched is limited because the user cannot provide a large force to the punching tools 44.

The present invention intends to provide a punch having a handle pivotally connected to the upper member so that the handle may be pivoted relative to the upper member so as to extend the distance between the punching tools and the handle. The punch of the present invention mitigates the disadvantages of the conventional punch.

SUMMARY OF THE INVENTION

In accordance with one aspect of the present invention, a punch is provided and comprises a first member and a second member which is pivotally connected to the first member by two lugs extending from the second member. Two apertures are defined through the second member. A transverse frame is connected between the two lugs and two punching tools movably extend through the transverse frame. Each punching tool has a spring mounted thereto and a first end of each punching tool contacts the underside of the first member and a second end of each punching tool extends through the transverse frame. The second end of each punching tool is located in alignment with the aperture corresponding thereto.

A rod has a first end thereof rotatably extending through the second member and the first member, and a second end of the rod movably extends through the second member. A handle is pivotally connected to the first end of the rod.

The main object of the present invention is to provide a punch having a handle pivotally connected thereto so that the distance between the punching tools and the handle can be adjusted.

Further objects, advantages, and features of the present invention will become apparent from the following detailed description with appropriate reference to the accompanying drawings.

DETAILED DESCRIPTION OF THE PREFERRED EMBODIMENT

Figure 1:
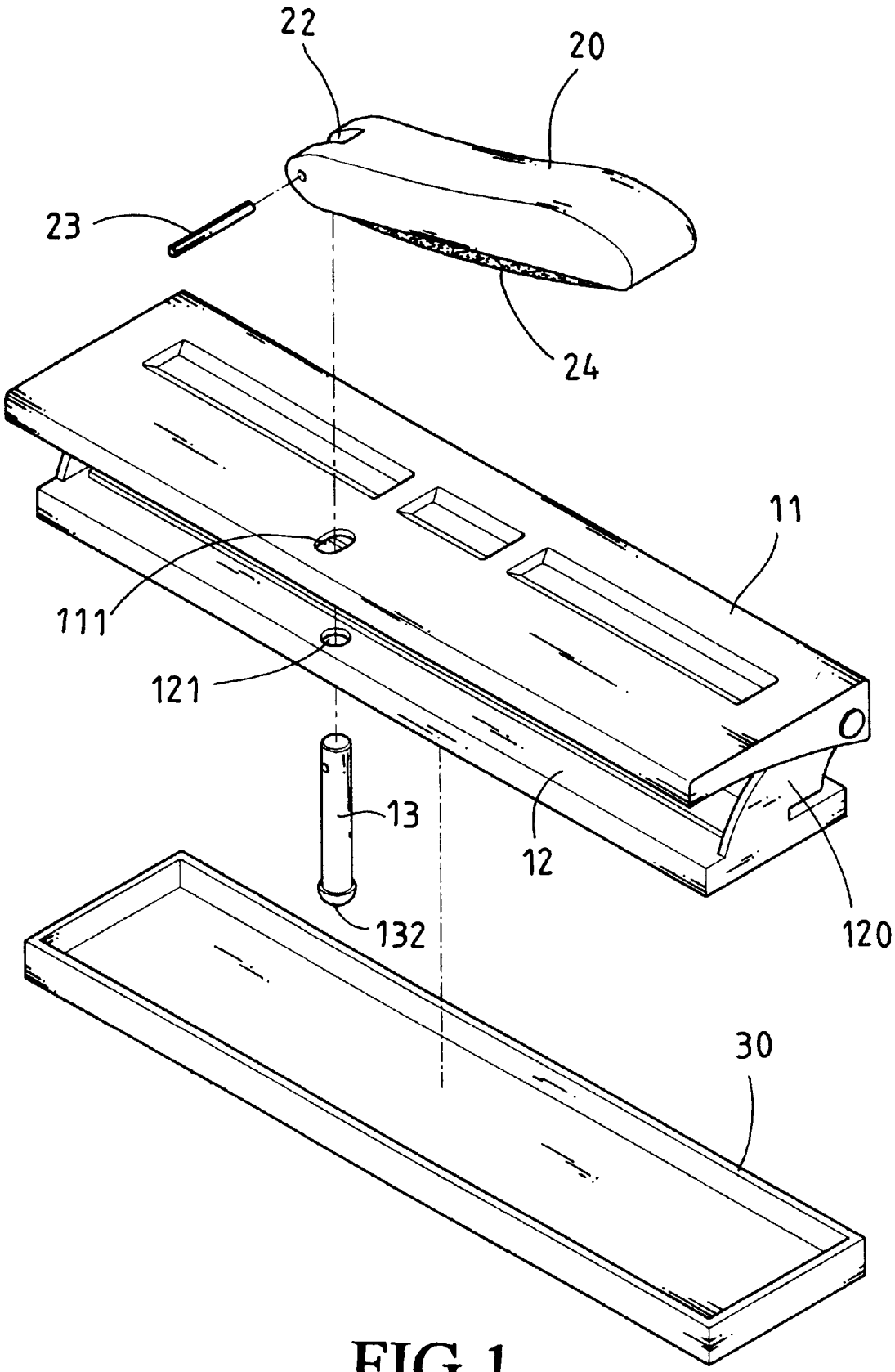
FIG. 1 is an exploded view of the punch in accordance with the present invention.
Figure 2:
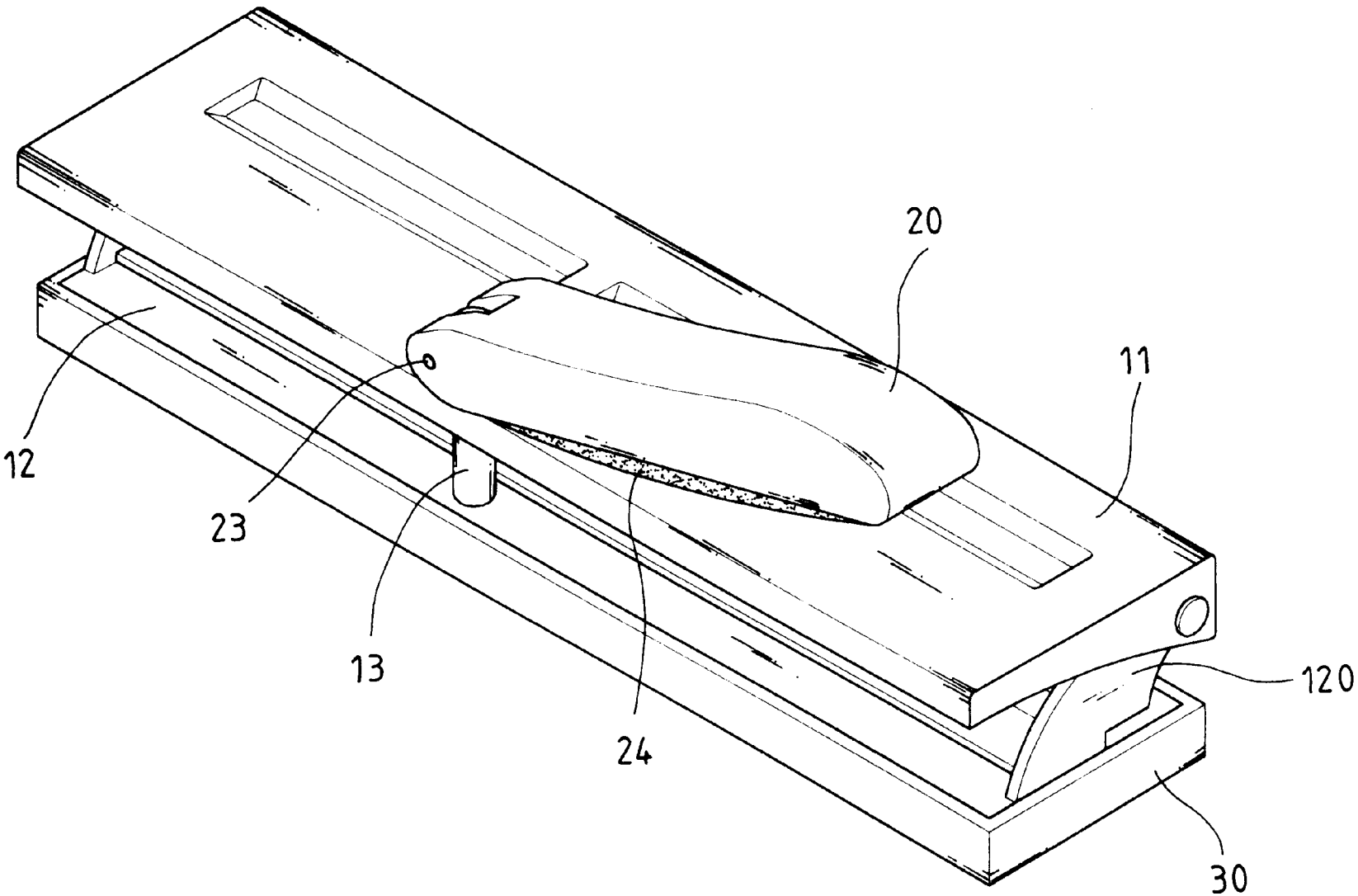
FIG. 2 is a perspective view of the punch in accordance with the present invention.
Figure 3:
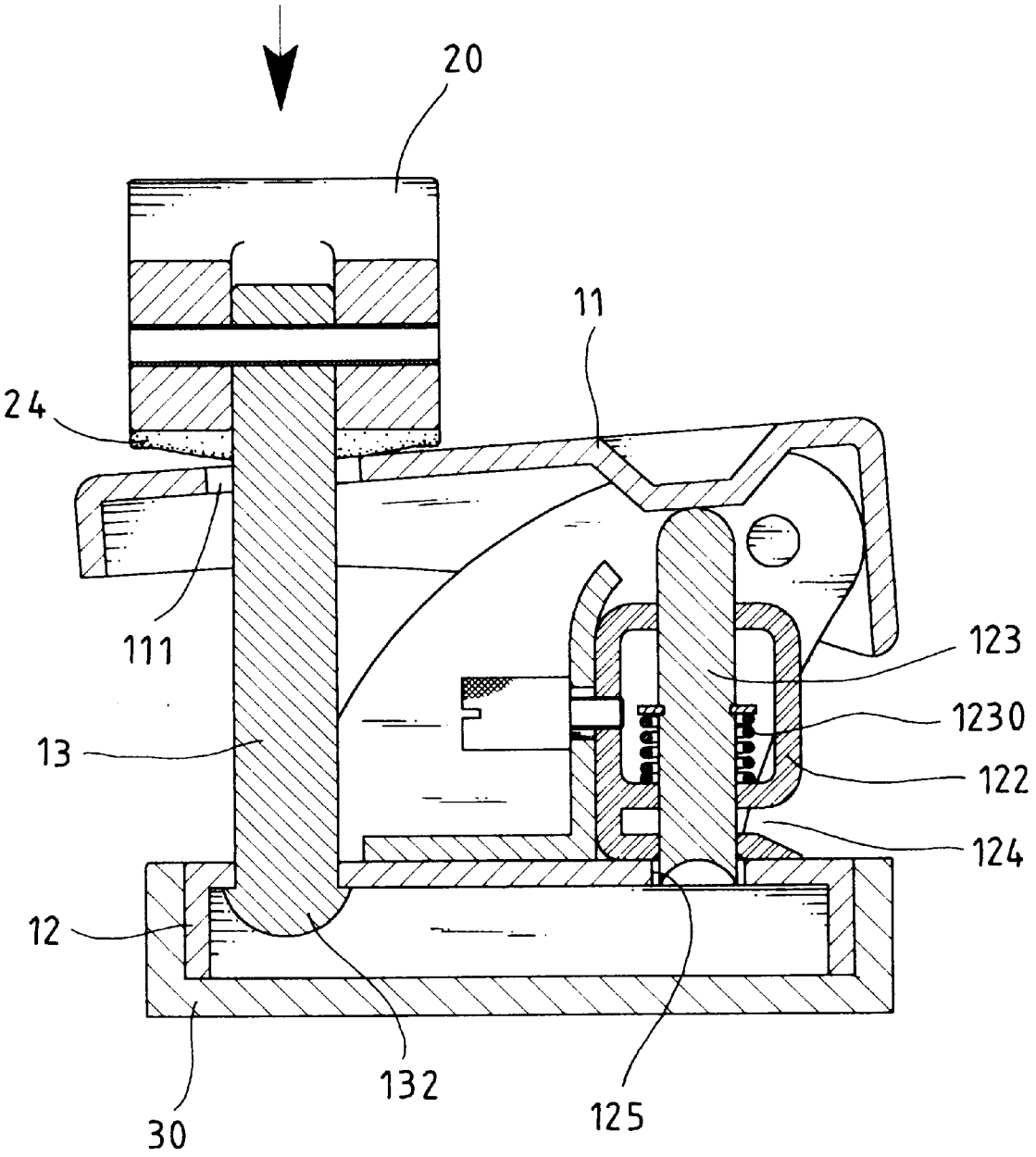
FIG. 3 is a side elevational view, partly in section, of the punch in accordance with the present invention.

Referring to FIGS. 1 to 3, the punch of the present invention comprises a first member 11 and a second member 12 which has two lugs 120 extending therefrom and the two lugs 120 are pivotally connected to the underside of the first member 11. An elongated hole 111 is defined through one of two sides of the first member. Two apertures 125 are defined through the first side of the second member 12 and a hole 121 is defined through the second side of the second member 12.

A transverse frame 122 is connected between the two lugs 120 and two punching tools 123 movably extend through the transverse frame 122. Each punching tool 123 has a spring 1230 mounted thereto so that when the punching tools 123 are pushed toward the second member 12, the springs 1230 provide a force to lift the punching tools 123. A first end of each punching tool 123 contacts a protrusion extending from the underside of the first member 11 and a second end of each punching tool 123 has cutting end extending through the transverse frame 122. The cutting ends of the punching tools 123 are located in alignment with the apertures 125 corresponding thereto. A gap 124 is defined between the transverse frame 122 and the second member 12 so that a pile of papers can be inserted into the gap 124. A collector 30 is mounted to the underside of the second member 12 and the apertures 125 in the second member 12 communicate with the collector 30.

A rod 13 has the first end thereof rotatably extending through the hole 121 of the second member 12 and the elongated hole 111 of the first member 11. The second end of the rod 13 has a flange 132 extending radially outward therefrom, the flange 132 having a diameter smaller than that of the hole 121 so that the second end of the rod 13 is retained by the hole 121.

A handle 20 has a notch 22 defined in one of two ends thereof and the first end of the rod 13 is pivotally received in the notch 22 by a pin 23 so that the handle 20 is pivotally connected to the first end of the rod 13. A rubber pad 24 is attached to a first side thereof and the rubber pad 24 has a curved surface protruding away from the handle 20.

Figure 4:
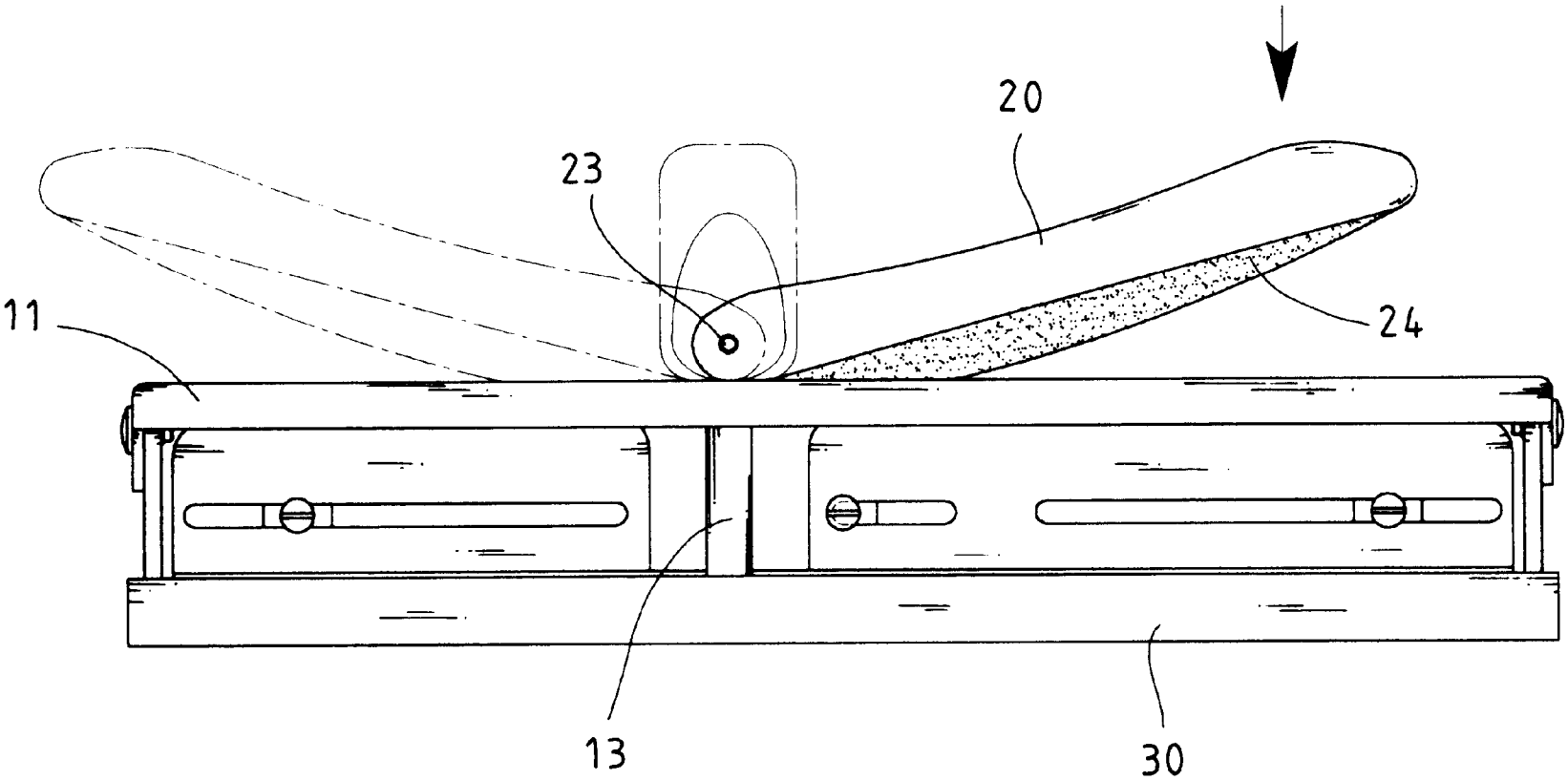
FIG. 4 is an illustrative view to illustrate the handle is pivoted relative to the first member of the punch of the present invention.

As shown in FIG. 4, the handle 20 is pivoted about the rod 13 as need and the curved surface of the rubber pad 24 provides a gap defined between the handle 20 and the first member 11 so that the user can push the handle 20 to let the punching tools 123 penetrate the apertures 125.

Figure 5:
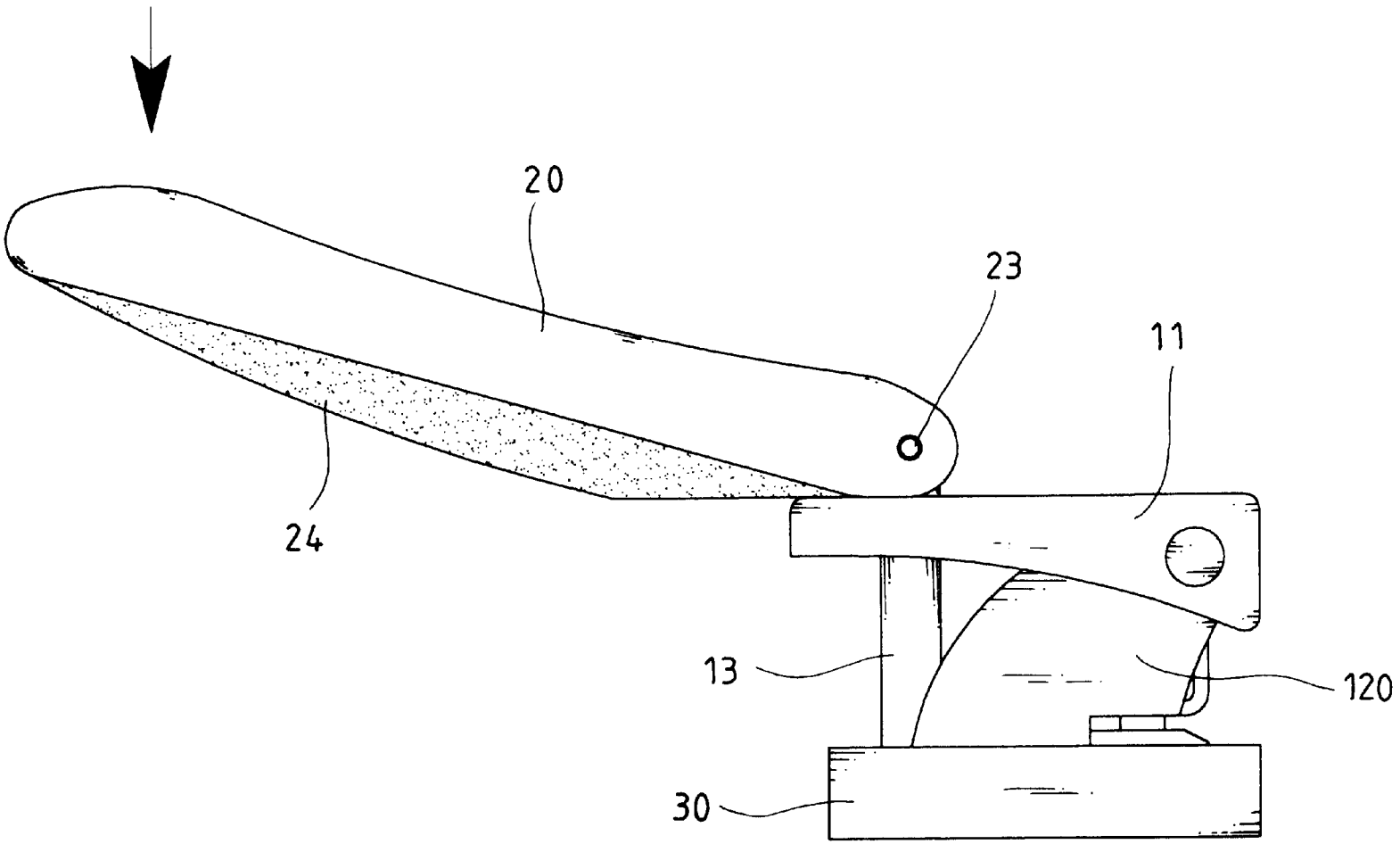
FIG. 5 is an illustrative view to illustrate the handle is pivoted away from the first member so as to increase the distance between the punching tools and the handle.

FIG. 5 shows the handle 20 is pivoted away from the first member 11 so that the distance between the punching tools 123 and the distal end of the handle 20 can be adjusted. In other words, the length of the arm for applying a downward force to the punching tools 123 is longer than the conventional punch so that the force to penetrate the papers is large enough.

Figure 6:
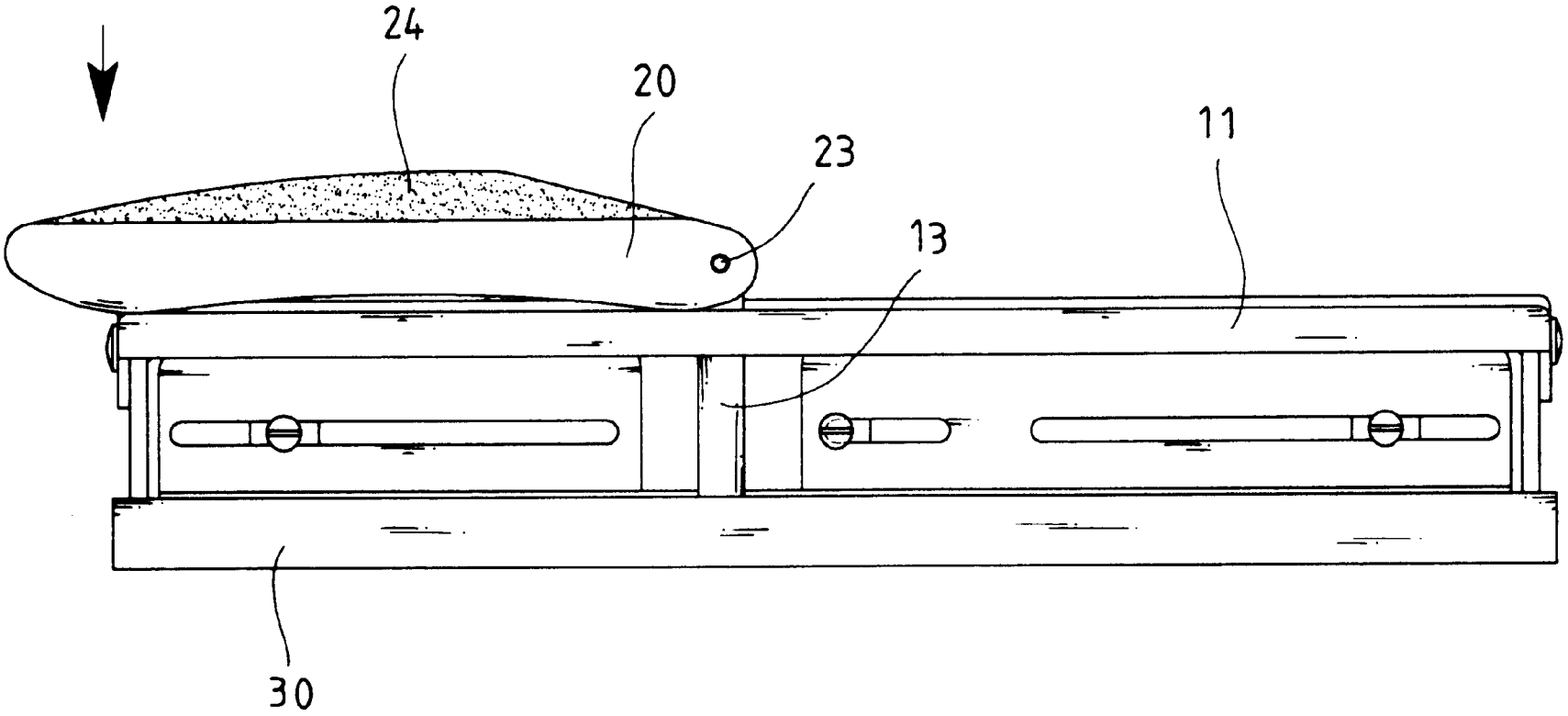
FIG. 6 is an illustrative view to illustrate the handle lain on the first member of the punch of the present invention.
Figure 7:
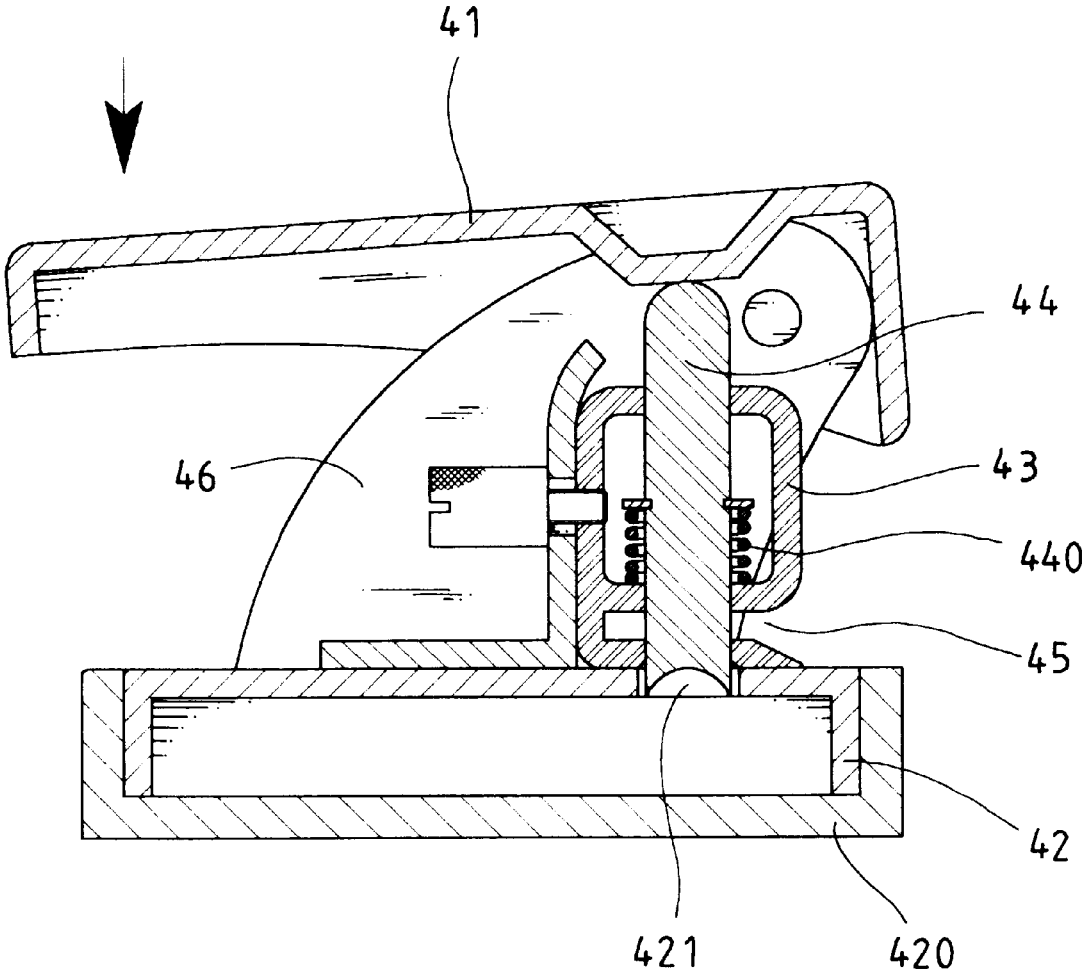
FIG.7 PRIOR ART
FIG. 7 is a side elevational view, partly in section, of a conventional punch.

As shown in FIG. 6, the handle 20 can be turned in reverse and let the second side of the handle 20 contact the first member 11. The second side of the handle 20 does not have a protrusion portion as that of the rubber pad 24 so that the handle 20 is lain on the first member 11. The positions of the handle 20 relative to the first member 11 can be decided by the user depending on the situations and needs of the users.

The invention is not limited to the above embodiment but various modification thereof may be made. It will be understood by those skilled in the art that various changes in form and detail may made without departing from the scope and spirit of the present invention.

What is claimed is:

1. A punch comprising:

a first member;

a second member having two lugs extending therefrom, said two lugs being pivotally connected to said first member, and two apertures defined through said second member;

a transverse frame connected between said two lugs and two punching tools movably extending through said transverse frame, each punching tool having a spring mounted thereto, a first end of each punching tool contacting an underside of said first member and a second end of each punching tool extending through said transverse frame, the second end of each punching tool located in alignment with one of said apertures;

a rod having a first end rotatably extending through said second member and said first member, a second end of said rod movably extending through said second member, and a handle pivotally connected to said first end of said rod.

2. The punch as claimed in claim 1 further comprising a collector mounted to the second member and said apertures in said second member communicate with said collector.

3. The punch as claimed in claim 1, wherein said first member has an elongated hole defined therethrough and said second member has a hole defined therethrough, said rod extending through said elongated hole and through said hole in said second member, and wherein the second end of said rod has a flange extending radially outward from said second end, said flange having a diameter smaller than that of said hole in said second member.

4. The punch as claimed in claim 1, wherein said handle has a notch defined in one of two ends thereof and said first end of said rod is pivotally received in said notch by a pin.

5. The punch as claimed in claim 1, wherein said handle has a rubber pad attached to a first side thereof and said rubber pad has a curved surface protruding away from said handle.

* * * * *